US010570613B2

(12) United States Patent
Lammer-Klupazek et al.

(10) Patent No.: US 10,570,613 B2
(45) Date of Patent: Feb. 25, 2020

(54) FIRE PROTECTION DEVICE FOR HUNG BACK-VENTILATED FACADES

(71) Applicant: EJOT Baubefestigungen GmbH, Bad Laasphe (DE)

(72) Inventors: Ewald Lammer-Klupazek, Baierdorf Bei Anger (AT); Klaus Holesinsky, Krottendof (AT); Michael Hellwig, Bad Laasphe (DE)

(73) Assignee: EJOT Baubefestigungen GmbH, Bad Laasphe (DE)

( * ) Notice: Subject to any disclaimer, the term of this patent is extended or adjusted under 35 U.S.C. 154(b) by 0 days.

(21) Appl. No.: 16/309,791

(22) PCT Filed: Jun. 16, 2017

(86) PCT No.: PCT/EP2017/064749
§ 371 (c)(1),
(2) Date: Dec. 13, 2018

(87) PCT Pub. No.: WO2018/001755
PCT Pub. Date: Jan. 4, 2018

(65) Prior Publication Data

US 2019/0127973 A1 May 2, 2019

(30) Foreign Application Priority Data

Jun. 28, 2016 (DE) ..... 10 2016 111 850

(51) Int. Cl.
*E04B 1/94* (2006.01)
*E04F 13/00* (2006.01)
*E04F 13/08* (2006.01)

(52) U.S. Cl.
CPC ..... *E04B 1/947* (2013.01); *E04F 13/007* (2013.01); *E04F 13/0835* (2013.01)

(58) Field of Classification Search
CPC ..... E04B 1/947; E04F 13/0835; E04F 13/007
See application file for complete search history.

(56) References Cited

U.S. PATENT DOCUMENTS 5,426,905 A * 6/1995 Rollhauser ..... A62C 2/06 411/396
2015/0059260 A1* 3/2015 Kallweit ..... E04F 13/007 52/99
2018/0142465 A1* 5/2018 Robinson ..... E01C 11/106

FOREIGN PATENT DOCUMENTS

DE 202006008125 U1 8/2006
DE 202012100418 U1 5/2013
(Continued)

OTHER PUBLICATIONS

International Search Report and Written Opinion for PCT/ISA/220 and PCT/ISA/237, International Application No. PCT/EP2017/064749, p. 1-7, International Filing Date Jun. 16, 2017, dated Oct. 25, 2017.

(Continued)

*Primary Examiner* — Joshua K Ihezie
(74) *Attorney, Agent, or Firm* — Bond Schoeneck & King, PLLC; George McGuire

(57) ABSTRACT

The invention relates to a fire protection device for hung back-ventilated facades, comprising a closure element which is designed to close a gap in a hung back-ventilated facade in the event of a fire, and which can be moved between an open position and a closed position, wherein a tension element is provided which impinges the closure element into the closed position and which can be moved between a pretensioned position and a closing position, wherein the closure element is retained in the pretensioned position by means of a securing element, wherein the (Continued)

securing element is designed in such a way that it releases the closure element when a temperature threshold value is exceeded.

21 Claims, 4 Drawing Sheets

(56) References Cited

FOREIGN PATENT DOCUMENTS

| | | | |
|---|---|---|---|
| DE | 202014102196 | U1 | 8/2014 |
| EP | 1731685 | A2 | 12/2006 |
| EP | 3034709 | A1 | 6/2016 |
| WO | 2013117479 | A1 | 8/2013 |

OTHER PUBLICATIONS

Search report from the German Patent Office for the German Priority Application 10 2016 111 850.8 filed Jun. 28, 2016, created Apr. 7, 2017.

* cited by examiner

FIRE PROTECTION DEVICE FOR HUNG BACK-VENTILATED FACADES

CROSS-REFERENCE TO RELATED APPLICATION

The present application is the United States National Stage Application under 35 U.S.C. 371 of International Application No. PCT/EP2017/064749, filed Jun. 16, 2017, which claims priority to German Application No. DE102016111850.8 filed Jun. 28, 2016, the entirety of each of which is hereby incorporated by reference.

BACKGROUND OF THE INVENTION

The invention relates to a fire protection device for hung back-ventilated facades, comprising a closure element which is designed to close a gap in a hung back-ventilated facade in the event of a fire, and which can be moved between an open and a closed position, wherein a tension element is provided which impinges the closure element into the closed position and which can be moved between a pretensioned position and a closing position, wherein the closure element is retained in the pretensioned position by means of a securing element, wherein the securing element is designed in such a way that it releases the closure element when a temperature threshold value is exceeded.

Hung back-ventilated facades are increasingly being used to create an attractive exterior facade on buildings, in particular on large office buildings. To do this, the hung back-ventilated facades of a building are arranged in front in such a way that a gap is created between the building wall and the hung back-ventilated facade or between a thermal barrier coating arranged on the building wall and the hung back-ventilated facade. The so-called back-ventilation gap can often extend across a plurality of stories. In the event of a fire, there is the possibility here that a source of the fire can spread from one story to another story via the back-ventilation gap. Fire protection devices from the prior art according to the preamble of claim 1 are known to prevent an extension of the flames into the back-ventilation gap and thus a spreading of the fire.

DE 20 2014 102 196 U1 shows such a fire protection device. The closure element in DE 20 2014 102 196 U1 is designed as a flap that is arranged on the hung facade. This flap is secured in an open position either by a flap attachment designed as a cord or alternatively secured by an additional pretensioning element, wherein the flap mounting melts at a specified temperature so that the flap is released.

It has now proven disadvantageous in the device known from DE 20 2014 102 196 U1 that the fire protection device, on the one hand, can only be mounted in a complicated way on the hung facade and, on the other hand, that the fire protection device has a complicated structure because of the flap design. Furthermore, it is not possible to integrate the fire protection device into a thermal barrier coating arranged on a building wall, the end result being a larger and more complicated structure of the whole hung facade.

SUMMARY OF THE INVENTION

The invention is therefore based on the object of providing a fire protection device for hung back-ventilated facades that, on the one hand, is easy to mount and to integrate into a thermal barrier coating and, on the other hand, has a simple structure and can be produced in a cost-effective manner.

This object is achieved by a fire protection device for hung back-ventilated facades. A fire protection device of this type is characterized in that a mounting element is provided which is designed to be mounted on the building wall and that the closure element is designed for mounting an insulation element on the building wall, wherein the mounting element and the closure element are arranged coaxially with respect to a central longitudinal axis of the fire protection device, wherein the closure element can be displaced axially between the open position and the closed position. Using a fire protection device of this type, an insulating element, in particular a fire-retardant and/or fireproof insulating element, can be mounted on a building wall, wherein the closure element can be moved into the closed position when a temperature threshold value is exceeded and thus a fire-retardant and/or fireproof insulating element mounted on the closure element can also be moved into the closed position in such a manner that a so-called back-ventilation gap of a hung back-ventilated facade can be closed. Here, it is particularly preferred if a longitudinally designed insulation element is mounted on a full width of a building via a plurality of fire protective devices, so that the back-ventilation gap can be closed along the whole width of the building wall when the fire protection devices are displaced into their respective closed positions. A fire protection device can thereby be provided that is simple and cost-efficient to produce and that is easy to mount and to integrate into a thermal barrier coating.

It has thus proven advantageous if the tension element impinges the closure element into the closing position. If the tension element impinges the closure element into its closing position axially, the closure element can thus be moved into its closed position if the securing element releases the closure element when a temperature threshold value is exceeded, for example in the event of a fire.

An advantageous development of the fire protection device provides that the closure element surrounds the mounting element at least in sections. It has proven particularly advantageous here if the mounting element is configured as a circular cylinder in the region in which the closure element is arranged on the mounting element. The closure element can thus be movably engaged axially on the mounting element in a simple manner.

According to a further embodiment of the fire protection device, it can be provided that the securing element is configured as a fuse or as a plastic cord that melts when a temperature threshold value is exceeded, or that the securing element is designed as a fluid-filled glass ampule containing an air bubble and pops when a temperature threshold value is exceeded, or that the securing element is designed as a fusible solder. If the securing element is designed as a fluid-filled glass ampule, an especially long functionality of the fire protection device, of even over 50 years, can be ensured because of the corrosion resistance of the glass ampule.

Advantageously, it is also provided that the closure element has a helical spiral mounting section which is designed to screw into a fire-retardant and/or inflammable insulation element.

It is particularly preferable here if the helical spiral mounting section has a helical pitch, wherein threads are provided on the mounting element that have a thread pitch corresponding to the helical pitch. The fire-retardant and/or fireproof insulation element can thus be arranged on the building wall first and then the fire protection device is simultaneously connected to the building wall via a rotational movement, on the one hand, and introduced into the fire-retardant and/or inflammable insulation element by means of the helical spiral mounting section, on the other hand.

An additional advantageous development of the fire protection device provides that the mounting element has a stop, wherein the tension element is arranged between the stop and the closure element. The tension element can thus be supported on the stop of the mounting element, on the one hand, and on the closure element, on the other, and impinge the closure element axially into the closed position.

In order to be able to attach the fire protection device to a building wall in a simple manner, it has proven advantageous if the mounting element has a mounting section and a shaft section, wherein the mounting section is configured to be arranged in a building wall. The mounting section can thus be an anchor, for example, which can be cemented into a building wall as screw threads or the like. It is especially advantageous here if the mounting element is designed as a circular cylinder in the region of the shaft section.

In order to be able to provide as large a support surface as possible for the tension element, it has further proven advantageous if the stop is designed as a flange-like annular collar that is arranged between the mounting section and the shaft section of the mounting element.

Here it is particularly advantageous if the stop is designed as a screw nut, wherein the mounting element has external threads, wherein the screw nut is screwed onto the external threads. The stop or the screw nut can thus be connected to the mounting element in a particularly simple and cost-effective manner.

In order to mount or to attach the mounting element to a building wall in as simple a manner as possible, it has proven advantageous if the mounting element has a torque drive section at its end on the shaft section pointing away from the mounting section. Via this torque drive section, a drive torque can be introduced into the mounting element by means of a screwing or impact tool, for example, so that the element can be displaced in a rotation, wherein threads provided, for example, on the mounting section and/or in a screw anchor and/or borehole arranged, for example, in the building wall can be screwed or driven into.

An additional particularly advantageous embodiment of the fire protection device provides that the shaft section has a length in the direction of the central longitudinal axis of the fire protection device and that the closure element has a length in the direction of the central longitudinal axis, wherein the length of the shaft section is greater than the length of the closure element.

It is thus possible in particular that the shaft section projects radially over the closure element and has a transverse bore in the region of its end pointing away from the mounting section that is designed for the arrangement of the securing element. A securing element can thus be arranged in the transverse bore in such a manner that the closure element is secured in the open position, wherein the securing element melts, for example when a temperature threshold value is exceeded, and correspondingly releases the closure element so that the closure element is displaced into the closed position by the tension element. It is also conceivable that the securing element is configured as a fuse or as a plastic cord that melts at a corresponding temperature threshold value.

In order to be able to move a flame-retardant and/or fireproof insulating element into the closed position in an easy manner, it has proven advantageous if the closure element has a disc-like pressure plate on a first end and if the closure element has a pressure sleeve on a second end, wherein the pressure sleeve on the second end of the closure element has a first cylindrical sleeve section and wherein a second sleeve section is provided between the first end and the second end of the closure element, wherein the closure element expands radially in the region of the second sleeve section and wherein the pressure plate is connected to the pressure sleeve at the first end in the region of the second sleeve section. The pressure plate here is advantageously circularly shaped.

It is particularly advantageous if the tension element in the region of the second sleeve section is arranged at least partially inside the pressure sleeve. The tension device can thus be protected from external influences such as from the penetration of moisture.

In a cost-effective and reliable development of the fire protection device, it has thus proven advantageous if the tension element is configured as a helical compression spring. It is also conceivable, however, that the tension element is configured as a disc spring assembly or elastic clamping element.

The aforementioned task is further achieved by a fire protection apparatus having the features of claim 17. A fire protection apparatus of this type comprises at least one fire protection device according to at least one of claims 1 to 16 and at least one fire-retardant and/or inflammable insulation element.

In order to be able to arrange the securing element outside the fire-retardant and/or inflammable insulation element, it is advantageous if the pressure sleeve has a length in the direction of the central longitudinal axis of the fire protection device that is greater than a thickness of the insulation element. The pressure sleeve thus projects over an insulating element even if it is mounted on the closure element.

Advantageously, a plurality of fire protection devices is provided, wherein the fire protection devices have a common securing element. Thus, all closure elements of the fire protection devices can be displaced simultaneously or almost simultaneously into the closing position when a temperature threshold value is exceeded.

The aforementioned task is additionally achieved by a fire protection method for hung back-ventilated facades having the features of claim 20. A fire protection method of this type comprises the following steps: horizontal arrangement of at least one fire-retardant and/or inflammable insulation element by means of a fire protection device according to at least one of claims 1 to 16. The insulation elements are advantageously arranged having the corresponding fire protection devices in a horizontal line, so that a back-ventilation gap can be closed over an entire width of a building wall in the event of a fire.

It has proven especially advantageous for a simple mounting if the fire protection device is first mounted on the building wall and after that the fire-retardant and/or fireproof insulation element.

BRIEF DESCRIPTION OF THE DRAWINGS

Further details and advantageous embodiments of the invention are described and explained in the following description with reference to the embodiment of the invention.

DETAILED DESCRIPTION

Figure 1:
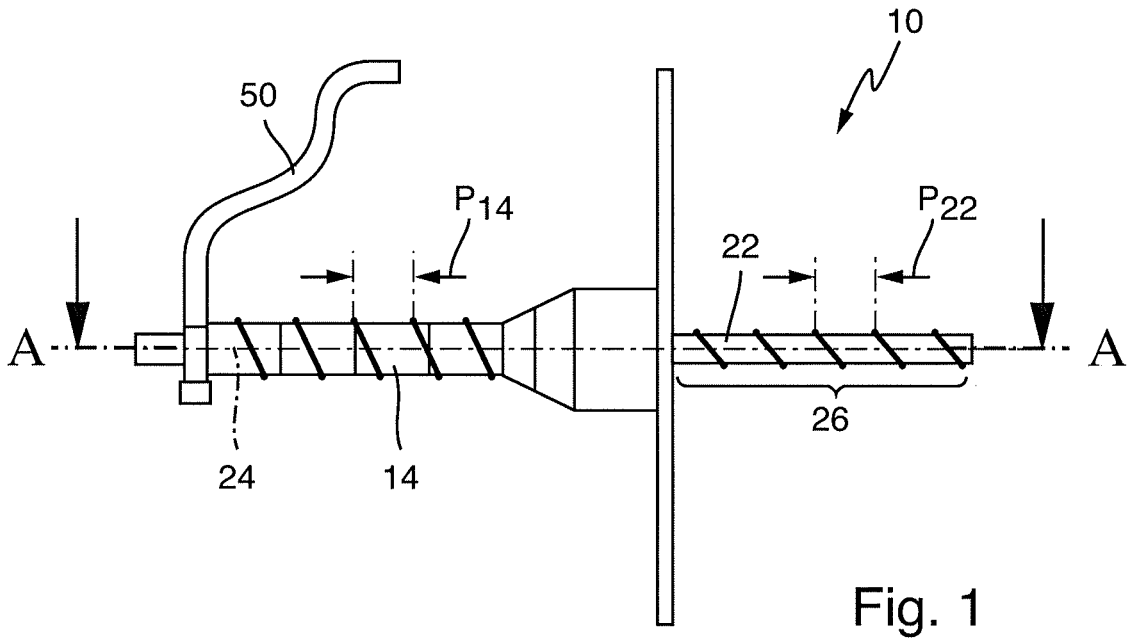
FIG. 1*a* side view of a fire protection device according to the invention.
Figure 2:
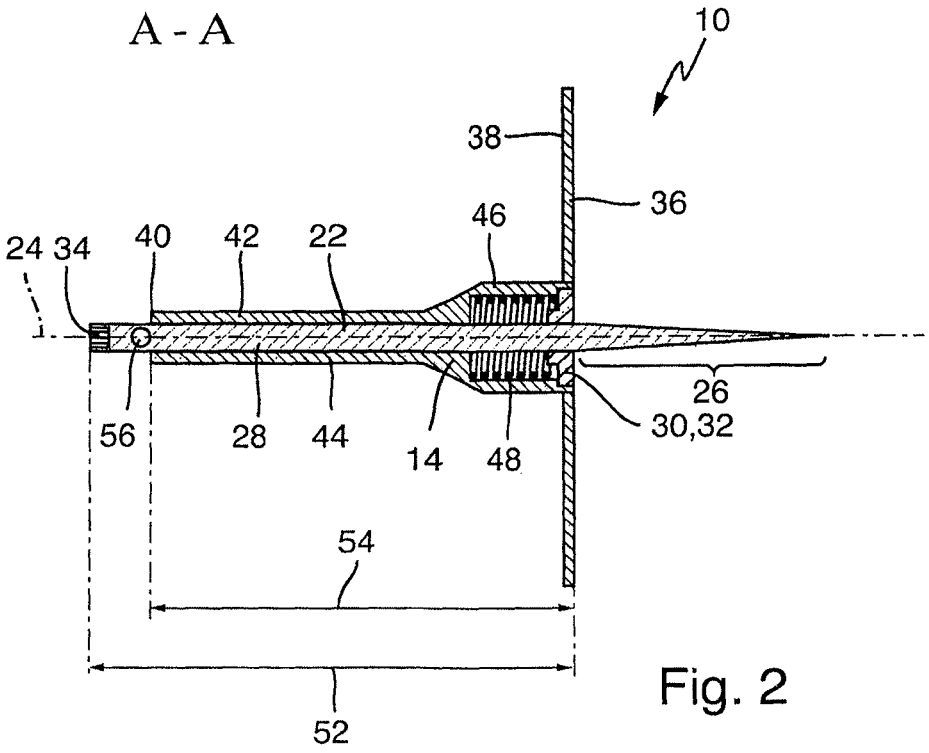
FIG. 2 a section through the fire protection device according to FIG. 1 along the line A-A.

In FIGS. 1 and 2, a fire protection device according to the invention is designated as a whole as 10, wherein the fire protection device 10 in FIG. 1 is illustrated in an open position. FIG. 2 shows the fire protection device 10 according to FIG. 1 in a cut along the line A-A.

Figure 3:
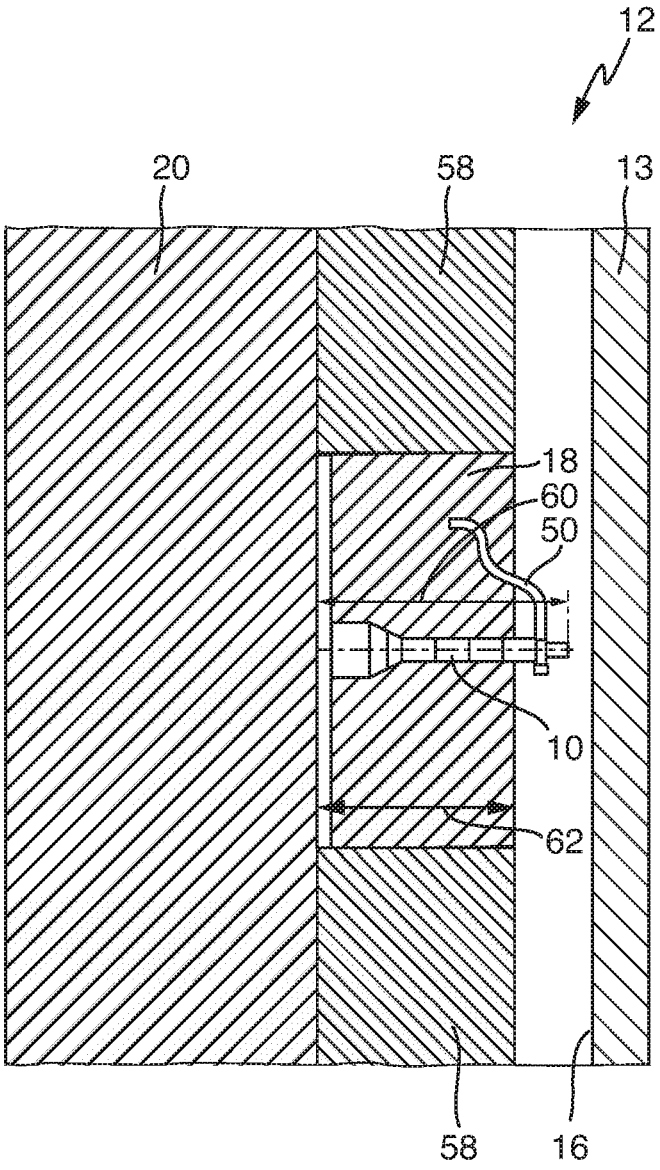
FIG. 3*a* fire protection device arranged in the open position on a hung back-ventilated facade as part of a fire protection apparatus according to FIGS. 1 and 2.
Figure 4:
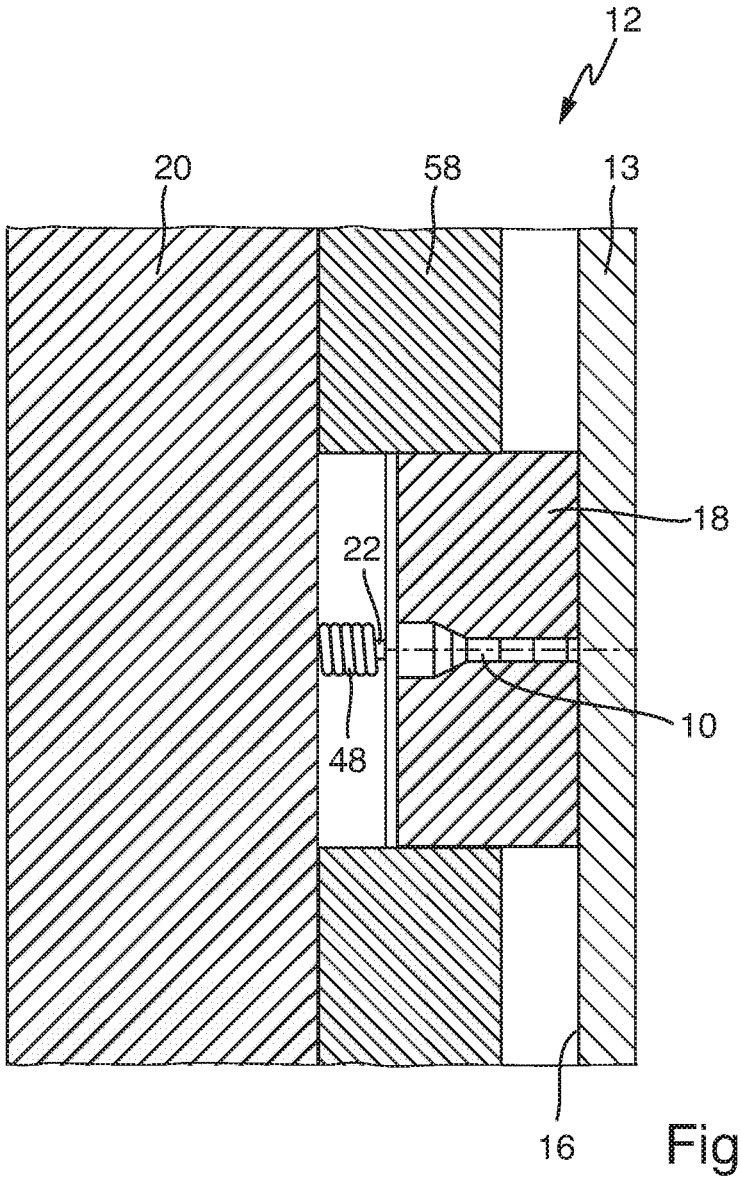
FIG. 4 the fire protection apparatus according to FIG. 3 with the fire protection device from FIGS. 1 and 2 in a closed position.

The fire protection device 10 is shown in FIGS. 3 and 4 as a part of a fire protection apparatus 12, wherein the fire protection device 10 in FIG. 3 is in the open position and in FIG. 4 is in a closed position.

Fire protection device 10 is designed as a fire protection device 10 for hung back-ventilated facades 13 and has a closure element 14 that is configured to close a gap 16 in a hung back-ventilated facade shown in FIGS. 3 and 4 and can be displaced between an open position and a closed position. Closure element 14 is configured for mounting an insulation element 18 in a building wall 20 (see FIGS. 3 and 4).

Fire protection device 10 further has a mounting element 22 that is designed for mounting to a building wall 20 (see FIGS. 3 and 4). Mounting element 22 and closure element 14 are arranged coaxially with respect to a central longitudinal axis 24 of fire protection device 10, wherein closure element 14 can be axially displaced meaning in the direction of central longitudinal axis 24 between the open and the closed position.

Closure element 14 radially surrounds central longitudinal axis 22 (meaning perpendicular to central longitudinal axis 24) at least in sections. Mounting element 22 has a mounting section 26 and a shaft section 28, wherein mounting section 26 is designed to be arranged in a building wall 20 (see FIGS. 3 and 4). Mounting section 26 can thus be designed as an anchor, for example, that can be cemented into a building wall as a screw thread or the like. In this manner, mounting element 22 has a circular cylindrical design in the region in which closure element 14 is arranged on mounting element 22, meaning shaft section 28. Closure element 14 can thereby be movably engaged axially on mounting element 22 or on shaft section 28 in a simple manner.

Mounting element 22 has a stop 30, which is designed as a flange-like annular collar and is arranged between mounting section 26 and shaft section 28 of mounting element 22. In the present case, stop 30 is designed as a screw nut 32, wherein mounting element 22 has an external thread not shown in the figures, wherein screw nut 32 is screwed onto the external threads. Stop 30 or screw nut 32 can thus be connected to mounting element 22 in a particularly simple and cost-effective manner.

In order to mount or to attach mounting element 22 to a building wall 20 in as simple a manner as possible, mounting element 22 has a torque drive section 34 on its end on shaft section 28 pointing away from mounting section 26. Via this torque drive section 34, a drive torque can then be introduced into mounting element 22 using, for example, a drill or cordless screwdriver, so that the element can be displaced in a rotation, wherein threads provided on mounting section 26, for example in a screw anchor arranged in the building wall 20 for the attachment of mounting element 22 in the building wall 20, can be screwed into.

Closure element 14 has a disk-like pressure plate 38 on a first end 36. Closure element 14 further has a pressure sleeve 42 on a second end 40. Pressure sleeve 42 has a first cylindrical, specifically circular cylindrical, sleeve section 44 at second end 40 of closure element 14. Moreover, pressure sleeve 42 has a second sleeve section 46 between first end 36 and second end 40 of closure element 14, wherein closure element 14 in the region of second sleeve section 46 expands radially, meaning perpendicular to central longitudinal axis 24. Pressure plate 38 is connected to pressure sleeve 42 at first end 36 in the region of second sleeve section 46. Pressure plate 38 is configured here as a circle and has a diameter in the range from about 20 mm to about 100 mm.

Fire protection device 10 further has a tension element 48 designed as a helical compression spring that impinges closure element 14 into the closing position and can be displaced between a pretensioned position and a closing position, wherein closure element 48 is retained in the pretensioned position via a securing element 50, wherein securing element 50 is designed in such a way that it releases closure element 14 when a temperature threshold value is exceeded. Tension element 48 impinges closure element 14 axially into the closing position. To do this, tension element 48 is arranged between stop 30 or screw nut 32 and closure element 14. Tension element 48 can thus be supported on stop 30 of mounting element 22, on the one hand, and on closure element 14, on the other, and impinge this axially into the closed position.

Tension element 48 is arranged in the region of second sleeve section 46 at least partially inside pressure sleeve 42. Tension element 48 can thus be protected from external influences such as the penetration of moisture.

Shaft section 28 has a length 52 in the direction of central longitudinal axis 24 of fire protection device 10, wherein closure element 14 has a length 54 in the direction of central longitudinal axis 24 of fire protection device 10. Length 52 of shaft section 28 is thus greater than length 54 of closure element 14 so that shaft section 28 projects axially over closure element 14 when closure element 14 is arranged on shaft section 28. Shaft section 38 here has a transverse bore in the region of its end pointing away from mounting section 26 that is designed for the arrangement of securing element 50. A securing element 50 can thus be arranged in transverse bore 56 in such a manner that closure element 14 can be secured in the open position, wherein securing element 50 melts, for example when a temperature threshold value is exceeded, and correspondingly releases closure element 14 so that closure element 14 is displaced into the closed position by tension element 48. It is also conceivable that securing element 50 is configured as a fuse or as a plastic cord that melts at a corresponding temperature threshold value.

The fire protection apparatus 14 shown in FIGS. 3 and 4 comprises at least one fire protection device 10 and at least one fire-retardant and/or inflammable insulation element 18. A thermal barrier coating 58 is arranged on building wall 20, wherein a longitudinally designed fire-retardant and/or inflammable insulation element 18 is mounted between thermal barrier coating 58 via a plurality of fire protection devices 10.

Pressure sleeve 42 has here a length 60 in the direction of the central longitudinal axis 24 of the fire protection device 10 that is greater than a thickness 62 of insulation element 18 or thermal barrier coating 58. Pressure sleeve 42 thus also then projects beyond insulation element 18 if it is mounted on closure element 14 of fire protection device 10. Securing element 50 can thus be arranged outside the fire-retardant and/or inflammable insulation element 18.

When a temperature threshold value is exceeded, securing element 50 can be melted, for example, so that closure element 14 is moved by tension element 48 into the closed position and so that fire-retardant and/or inflammable insulation element 18 mounted on closure element 14 is also moved into the closed position in such a manner that a so-called back-ventilation gap 16 of a hung back-ventilated facade 13 can be closed. Via fire-retardant and/or inflammable insulation element 18, the longitudinal back-ventilation gap 16 can thus be closed along a complete width of building wall 20.

In the event of a fire, the possibility that a source of the fire can spread from one story to another story via the back-ventilation gap 16 can therefore be prevented.

A fire protection device 10 can thus be provided that is simple and cost-efficient to produce and that is easy to mount and to integrate into a thermal barrier coating 58.

What is claimed is:

1. A fire protection device for hung back-ventilated facades, comprising a closure element which is designed to close a gap in a hung back-ventilated facade in the event of a fire, and which can be moved between an open position and a closed position, wherein a tension element is provided which impinges the closure element into the closed position and which can be moved between a pretensioned position and a closing position, wherein the closure element is retained in the pretensioned position by means of a securing element, wherein the securing element is designed in such a way that it releases the closure element when a temperature threshold value is exceeded, characterized in that a mounting element is provided that is designed for mounting on a building wall, and that the closure element is designed for mounting an isolation element on the building wall, wherein the mounting element and the closure element are arranged coaxially with respect to a central longitudinal axis of the fire protection device, wherein the closure element can be displaced axially between the open position and the closed position.

2. The fire protection device for hung back-ventilated facades according to claim 1, wherein the tension element axially impinges the closure element in the closed position.

3. The fire protection device for hung back-ventilated facades according to claim 1, wherein the closure element radially surrounds the mounting element at least in sections.

4. The fire protection device for hung back-ventilated facades according to claim 1, wherein the securing element is designed as one of: a fuse, a plastic cord, a fluid-filled glass ampule that contains an air bubble and pops when a temperature threshold value is exceeded, or a fusible solder.

5. The fire protection device for hung back-ventilated facades according to claim 1, wherein the closure element has a helical spiral mounting section that is designed to be screwed into at least one of a fire-retardant and fireproof insulating element.

6. The fire protection device for hung back-ventilated facades according to claim 5, wherein the helical spiral mounting section has a helical pitch, wherein threads are provided on the mounting element that have a thread pitch corresponding to the helical pitch.

7. The fire protection device for hung back-ventilated facades according to claim 1, wherein the mounting element has a stop, wherein the tension element is arranged between the stop and the closure element.

8. The fire protection device for hung back-ventilated facades according to claim 1, wherein the mounting element has a mounting section and a shaft section, wherein the mounting section is configured to be arranged in a building wall.

9. The fire protection device for hung back-ventilated facades according to claim 8, wherein the stop is designed as a flange-like annular collar that is arranged between the mounting section and the shaft section of the mounting element.

10. The fire protection device for hung back-ventilated facades according to claim 7, wherein the stop is designed as a screw-nut, wherein the mounting element has an external thread, wherein the screw-nut is screwed onto the external thread.

11. The fire protection device for hung back-ventilated facades according to claim 7, wherein the mounting element has a torque drive section on its end on the shaft section pointing away from the mounting section.

12. The fire protection device for hung back-ventilated facades according to claim 7, wherein the shaft section has a length in the direction of the central longitudinal axis of the fire protection device and wherein the closure element has a length in the direction of the central longitudinal axis of the fire protection device, wherein the length of the shaft section is greater than the length of the closure element.

13. The fire protection device for hung back-ventilated facades according to claim 7, wherein the shaft section projects axially over the closure element and has a transverse bore in the region of its end pointing away from the mounting section that is designed for the arrangement of the securing element.

14. The fire protection device for hung back-ventilated facades according to claim 1, wherein the closure element has a disc-like pressure plate on a first end and wherein the closure element has a pressure sleeve on a second end, wherein the pressure sleeve on the second end of the closure element has a first cylindrical sleeve section and wherein a second sleeve section is provided between the first end and the second end of the closure element, wherein the closure element in the region of the second sleeve section expands radially and wherein the pressure plate is connected to the pressure sleeve on the first end in the region of the second sleeve section.

15. The fire protection device for hung back-ventilated facades according to claim 14, wherein the tension element in the region of the second sleeve section is arranged at least partially inside the pressure sleeve.

16. The fire protection device for hung back-ventilated facades according to claim 1, wherein the tension element is designed as a helical compression spring.

17. A fire protection apparatus comprising at least one fire protection device comprising a closure element which is designed to close a gap in a hung back-ventilated facade in the event of a fire, and which can be moved between an open position and a closed position, wherein a tension element is provided which impinges the closure element into the closed position and which can be moved between a pretensioned position and a closing position, wherein the closure element is retained in the pretensioned position by means of a securing element, wherein the securing element is designed in such a way that it releases the closure element when a temperature threshold value is exceeded, characterized in that a mounting element is provided that is designed for mounting on a building wall, and that the closure element is designed for mounting an isolation element on the building wall, wherein the mounting element and the closure element are arranged coaxially with respect to a central longitudinal axis of the fire protection device, wherein the closure element can be displaced axially between the open position and the closed position and at least one of a fire-retardant and fireproof insulating element.

18. The fire protection apparatus according to claim 17, wherein the closure element has a pressure sleeve, and wherein the pressure sleeve in the direction of the central longitudinal axis of the fire protection device has a length that is greater than a thickness of the insulating element.

19. The fire protection apparatus according to claim 17, wherein a plurality of fire protection devices is provided, wherein the fire protection devices have a common securing element.

20. A fire protection method for hung back-ventilated facades comprising the following steps: providing a fire protection device comprising a closure element which is designed to close a gap in a hung back-ventilated facade in the event of a fire, and which can be moved between an open position and a closed position, wherein a tension element is provided which impinges the closure element into the closed position and which can be moved between a pretensioned position and a closing position, wherein the closure element is retained in the pretensioned position by means of a securing element, wherein the securing element is designed in such a way that it releases the closure element when a temperature threshold value is exceeded, characterized in that a mounting element is provided that is designed for mounting on a building wall, and that the closure element is designed for mounting an isolation element on the building wall, wherein the mounting element and the closure element are arranged coaxially with respect to a central longitudinal axis of the fire protection device, wherein the closure element can be displaced axially between the open position and the closed position; and horizontally arranging at least one of a fire-retardant and a fireproof insulation element on a building wall by means of the fire protection device.

21. The fire protection method for hung back-ventilated facades according to claim 20, further comprising the step of first arranging the fire protection device on the building wall and afterward the one of the fire-retardant and/or fireproof insulation element.

* * * * *